United States Patent [19]

Kraehn

[11] Patent Number: 5,074,342

[45] Date of Patent: Dec. 24, 1991

[54] DEVICE FOR NON-CONTAMINATING CHANGING OF A TONER CONTAINER IN A TONER CONVEYING MEANS OF A NON-MECHANICAL PRINTER OR COPIER MEANS

[75] Inventor: Erich Kraehn, Karlsfeld, Fed. Rep. of Germany

[73] Assignee: Siemens Aktiengesellschaft, Munich, Fed. Rep. of Germany

[21] Appl. No.: 347,881

[22] PCT Filed: Sep. 25, 1987

[86] PCT No.: PCT/DE87/00442

§ 371 Date: Apr. 3, 1989

§ 102(e) Date: Apr. 3, 1989

[87] PCT Pub. No.: WO88/02505

PCT Pub. Date: Apr. 7, 1988

[30] Foreign Application Priority Data

Oct. 2, 1986 [DE] Fed. Rep. of Germany ..... 3633593

[51] Int. Cl.[5] ..... B65B 1/28; G03G 15/00

[52] U.S. Cl. ..... 141/65; 406/115; 141/67; 141/93; 141/97; 141/59; 141/263; 141/375; 141/329; 141/86; 141/90; 222/DIG. 1; 355/260

[58] Field of Search ..... 406/114-115; 141/86, 88, 89, 90

[56] References Cited

U.S. PATENT DOCUMENTS

| | | | |
|---|---|---|---|
| 2,419,386 | 4/1947 | Berg . | |
| 3,754,580 | 8/1973 | Perry | 141/65 |
| 3,784,297 | 1/1974 | Ito et al. . | |
| 3,840,055 | 10/1974 | Wostl et al. | 141/97 X |
| 3,867,969 | 2/1975 | Garnett | 141/59 |
| 3,883,240 | 5/1975 | Ito et al. . | |
| 3,954,331 | 4/1976 | Smith | 355/260 |
| 3,994,532 | 11/1976 | Hahn | 406/115 |
| 4,076,503 | 2/1978 | Atwood et al. | 141/90 X |
| 4,121,632 | 10/1978 | Zehr | 141/59 |
| 4,265,572 | 5/1981 | Bourdois et al. . | |
| 4,274,455 | 7/1981 | Simons . | |
| 4,305,529 | 12/1981 | Spehrley, Jr. | 222/DIG. 1 |
| 4,465,112 | 8/1984 | Kopp . | |
| 4,561,759 | 12/1985 | Knott . | |
| 4,583,660 | 4/1986 | La Borre et al. | 222/DIG. 1 |

FOREIGN PATENT DOCUMENTS 2944443 5/1981 Fed. Rep. of Germany ..... 141/65

OTHER PUBLICATIONS

Patent Abstracts of Japan, vol. 10, No. 223(P-483) (2279), Aug. 5, 1986, 61059465.

Xerox Disclosure Journal, vol. 1, No. 8, Aug. 1976, "Pneumatic Toner Conveying System", Daniel J. Harmon.

*Primary Examiner*—Ernest G. Cusick

[57] ABSTRACT

In a toner transfer system of a printer or copier, a suction nozzle inside a toner-tight protective sheath is arranged in verticallly displaceable fashion in a guide in the printer or copier, this suction nozzle being in communication via a pipe line with a developer station of the printer or copier. At it slower end, the guide has an adaptor for connection to a toner container. When the toner container is to be changed, the toner container is swivelled via a holding mechanism and a new container is connected to the adaptor. A cutter on the adaptor then punctures a sealing foil over the filling and emptying opening of the toner container. For emptying, the suction nozzle moves vertically into the toner container whose floor is fashioned funnel-shaped to form a toner collecting region.

9 Claims, 7 Drawing Sheets

DEVICE FOR NON-CONTAMINATING CHANGING OF A TONER CONTAINER IN A TONER CONVEYING MEANS OF A NON-MECHANICAL PRINTER OR COPIER MEANS

BACKGROUND O THE INVENTION

The invention is directed to a device for the transport of toner from the transport container into a developer station of a non-mechanical printer or copier means.

In copier technology and in modern fast data printers that operate on the principle of electrophotography, charge images are generated on a recording medium, for example directly on an intermediate carrier (photoconductive drum) or directly on special paper, and are subsequently inked with a black powder (toner) in a developer station. Given employment of an intermediate carrier, this toner image is subsequently transferred onto normal paper and fixed thereon.

As a rule, a two-component developer that is composed of ferromagnetic carrier particles and of the toner particles carrying the color is used. The developer is conducted past the charge image on the intermediate carrier with a magnetic brush arrangement, the toner adhering thereto as a result of electrostatic forces.

An electrophotographic copier means that develops charge images according to the principle addressed above is disclosed, for example, from DE-AS 21 66 667, and corresponding U.S. Pat. Nos. 3,784,297 and 3,883,240.

Due to the inking of the charge images on the intermediate carrier, the toner concentration in the developer mix of the developer station constantly decreases. It is therefore necessary to constantly supply new toner to the developer mix in metered fashion. Since the toner consumption per time unit is extremely high in fast copier means and high-performance data printers, a roomy toner reservoir is used in such apparatus in order to avoid down time caused by refilling toner. When this toner reservoir is empty, the toner that is usually supplied in handy containers is filled into the reservoir. It is thereby important to fill the toner from the container into the reservoir such that no toner is spilled and thereby contaminates the environment.

German Patent 32 24 296 and corresponding U.S. Pat. No. 4,561,759 discloses an apparatus for filling and sieving toner from a container into a toner reservoir. The toner situated in a transport container, namely in a toner bottle, is thereby supplied to a reservoir in that the toner bottle is inverted into a filling aperture of the reservoir. A strainer basket that is closed from the reservoir with a sieve is arranged in the region of the filling aperture, this strainer basket being in communication with an electrical shaker means that can be triggered as needed. The shaker means is thereby triggered by opening the cover that closes the filling aperture In such filling devices, there is then the risk that the toner will be spilled given manual decanting from the toner bottle. Since, moreover, the toner is only supplied to the toner reservoir at a defined location, special distributor devices are needed in the toner reservoir in order to guarantee a uniform supply of the toner to the developer station.

Xerox Disclosure Journal, Vol,1, No.8, Aug. 1976, page 47, also discloses that toner be supplied to the developer station from a reservoir arranged at a distance therefrom in that air is blown through the reservoir This air then transports the toner into the developer station JP-A-61-59 465 discloses a toner delivery means wherein toner is suction from a toner container with the assistance of a suction means and a line system and is supplied to the reservoir of a developer station EP-A-8 270 also discloses that powdery material be suctioned from a container with the assistance of a suction nozzle that is composed of an inside tube and of an outside tube

SUMMARY OF THE INVENTION

It is an object o the invention to fashion a toner container of the species initially cited such that the toner can be delivered to non-mechanical printer or copier means in a simple way without toner being released contaminating the environment.

In a toner container of the species initially cited, this object is achieved by a suction nozzle displaceably arranged in a guide means inside a toner type protective sheath, this suction nozzle being in communication via a platform with the developer station and by an adapter connected o the protective sheath for releasable toner-type fastening to a filling and emptying opening of a toner container. The suction nozzle immerses through the adapter into the toner container for emptying the toner container.

Advantageous embodiments of the invention are provided in that the guide means that accepts the suction nozzle in vertically displaceable fashion is arranged above a holding mechanism for the acceptance of the toner container such that suction nozzle immerses into the toner container on the basis o its dead weight during the a draw-off event.

The holding mechanism is preferably fashioned to be pivotable out of a means for accepting the toner container. The adapter has a safety means for the suction nozzle that, first, enables an immersion of the suction nozzle into the toner transport container only safe the transport container has been connected to the adapter and, second, prevents release of the connection when the suction nozzle is immersed. Preferably, the adapter includes a cuter means for puncturing the foil that covers the filling and removal opening of the toner container in its filled condition. The protective sheath of a preferred embodiment of composed of a flexible accordion bellows that is secured, first, through the connecting region of the suction nozzle and, second, to the adapter. The adapter comprises a toner stripper ring which accepts the suction nozzle.

In a preferred form, the toner container has a funnel-shaped floor that forms a lowest collecting region of the toner, whereby the filling and emptying opening int the collecting region are arranged relative to one another such that given fastening of the toner container of in the holding mechanism in a removal position wherein the collecting region forms that slowest region of the toner container, the suction nozzle allocated o the printer or copier means immerses in the collecting region. The suction nozzle is preferably an inner tube having take in openings and connected to a pipe line and also comprises an outside tube enveloping the inner tube at a distance therefrom, whereby the outside tube has toner entry openings and an air intake opening so that intake air flowing from the outside tube suctions the toner thought the toner entry opening of the inside tube.

In that the toner is removed from the toner container with the assistance of a suction nozzle that is arranged inside a protective sheath that is connected via an adapter to a filling and emptying opening of the toner container, no toner dust can contaminate the environment.

A safety means sees to it that the suction nozzle cannot dip into the toner container for draw-off until a dust-tight connection between the filling and emptying opening of the toner container and the adapter is established. The same safety mechanism also prevents a release of the closure when the suction nozzle is immersed.

The toner containers are delivered with a sealed filling and emptying opening in an advantageous way. The adapter is thereby fashioned such that the adapter does not penetrate the sealing foil via a cutter means until the toner container is connected to the adapter. It is thus not possible to spill toner when inserting the toner container into the corresponding receptacle device in the printer means.

In an advantageous embodiment of the invention, the changing of the toner container is facilitated in that the container that accepts the toner container is fashioned pivotable out of the printer.

The special shape of the toner container comprising a funnel-shaped floor enables the complete emptying of the toner container with the assistance of the vertically displaceable suction nozzle.

The suction nozzle that comprises delivery openings for toner at its tip is composed of an inside tube and of an outside tube that completely envelopes the inside tube. The air taken in via air intake openings of the draw-in tube initially flows through the outside tube and then flows through the inside tube. Via toner delivery openings in the take-in region of the outside tube, the toner is entrained into the inside tube by the air stream.

The toner container can thus be completely emptied without special aeration openings.

BRIEF DESCRIPTION OF THE DRAWINGS

Embodiments of the invention are shown in the drawings and shall be set forth in greater detail below by way of example. Shown are.

DESCRIPTION OF THE PREFERRED EMBODIMENT

Figure 3:
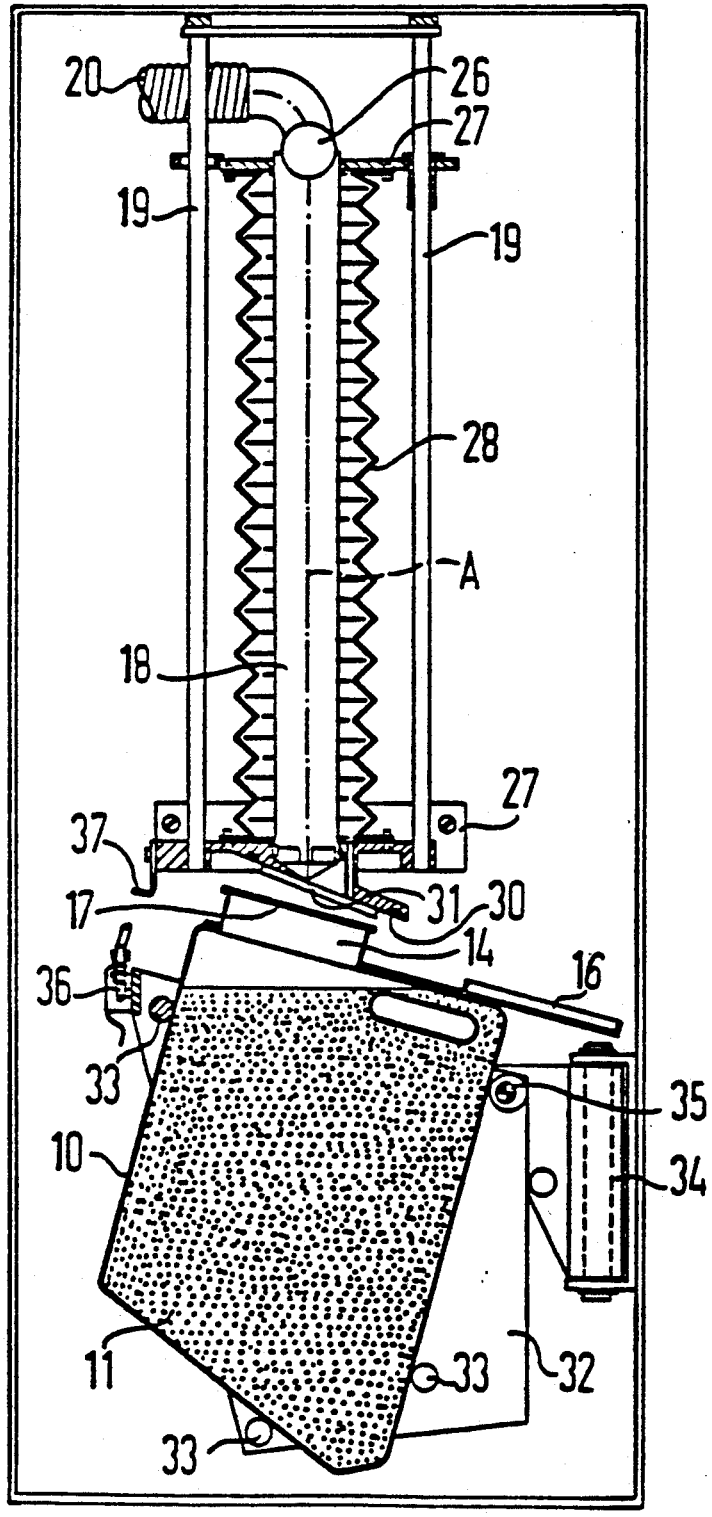
FIG. 3 is a schematic illustration of the toner delivery region of a printer means with an inserted, filled toner bottle before connection to the draw-off device.

A printer means that operates based on the electrophotographic principle and that is not shown in detail here contains a toner delivery region (FIG. 3) for the acceptance of a toner container 10 manufactured of plastic and having an appertaining draw-off means via which the powdery toner 11 is supplied to a developer station (not shown here) of the printer means. An emptying region (FIG. 8) is also provided in the printer means, an empty toner container 10 as a collecting container for the developer mix being capable of being secured therein when emptying the developer station.

In a known way, a charge image is inked with toner in the developer station of the printer means via a two-component developer mix composed of toner and carrier particles. This developer mix, on one hand, must be refreshed from time to time by adding toner; and on the other hand, it is necessary after a longer operating time to replace the entire developer mix.

The toner container 10 is designed for the acceptance of about 3 kg of toner powder. Its container walls thereby form planar surface, whereby one surface 12 is designed as a supporting surface. The upper wall surfaces of the toner container form a cuboid having parallel surfaces, this enabling a space-saving stacking of the toner containers. A handle 13 is thereby arranged such integrated into the wall surfaces that, first, easy carrying of the toner container 10 is enabled and, second, a stacking of a plurality of toner containers is not impeded. Adjoining the supporting surface 13, the container walls 12/5 and 12/6 together with the container wall 12/1 and the supporting surface 12 form a funnel-shaped collecting region for the toner. A filling and emptying opening 14 is situated lying opposite this collecting region and can be closed with a cover 16 having an insert 9 of expanded material and that is captively secured via a clip 15.

After being filled with toner powder 11, the opening 11 itself is sealed with an aluminum foil 17.

Figure 1:
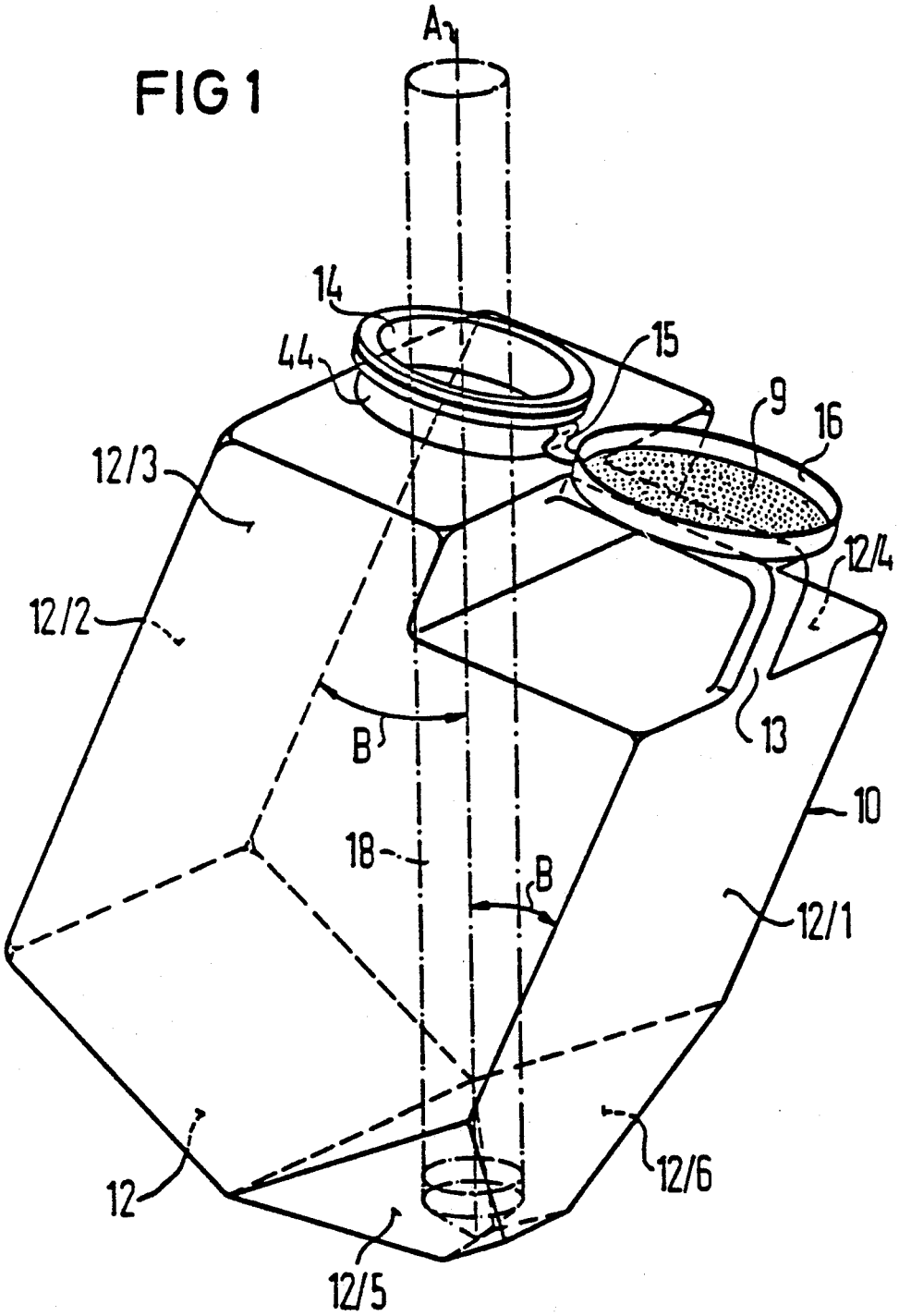
FIG. 1 is a schematic illustration of the toner container.
Figure 2:
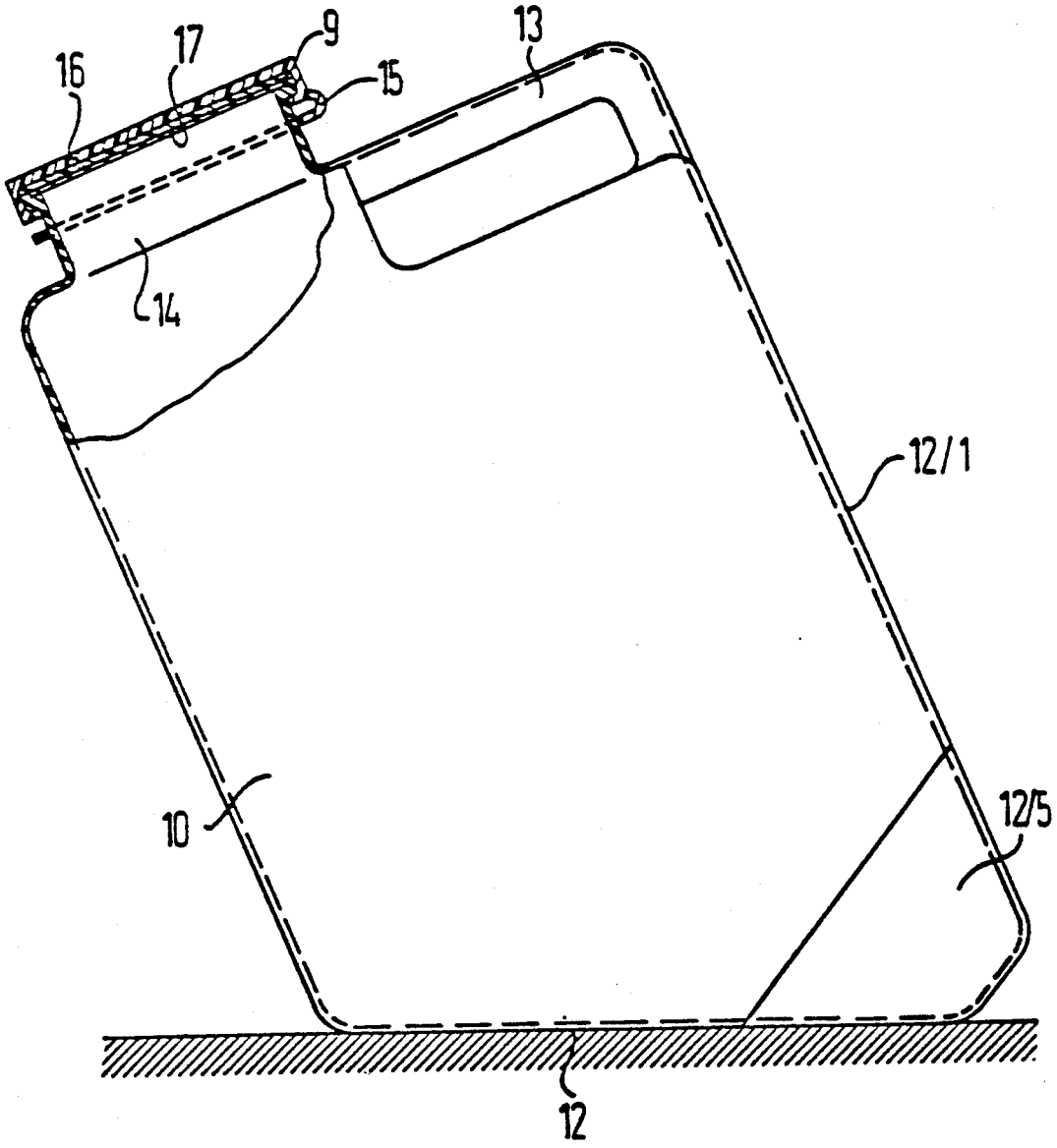
FIG. 2 is a schematic sectional view of the toner container.

The collecting region and filling and emptying opening 14 are arranged such relative to one another that, according to FIG. 1, the suction nozzle 18 introduced from above into the toner container penetrates up to the collecting region after a corresponding draw-off of the toner powder.

In this characteristic removal position shown in FIG. 1, the collecting region forms the lowest point of the toner container. With reference to the vertical axis A of the introduction or, respectively, removal position of the toner container, the walls thereby describe an angle B that amounts to less than 45°.

This means that all walls in the illustrated emptying position of FIG. 1 have a slant relative to the vertical axis A that prevents the toner from adhering to the walls of the container given removal with the suction nozzle 18 in combination with a beater/shaker means. During emptying, the toner collects in the collecting region formed by the walls 12/5 and 12/6 or, respectively, 12 and 12/1 that forms the lowest location of the container and can be completely drawn off from there.

In order to be able to supply the toner from the toner container 10 to the developer station in functionally reliable fashion without contaminating the environment, the toner delivery region comprises a draw-off means for the toner and comprises a corresponding holding mechanism for the toner container 10.

The draw-off means is thereby composed of the suction nozzle 18 arranged in vertically displaceable fashion between guide rods 19, this suction nozzle 18 being in communication via a flexible suction pipe 20 with a blower of the printer that is not shown here. The blower suctions the toner out of the toner container 10 via the suction nozzle and deposits it in the developer station.

Figure 4:
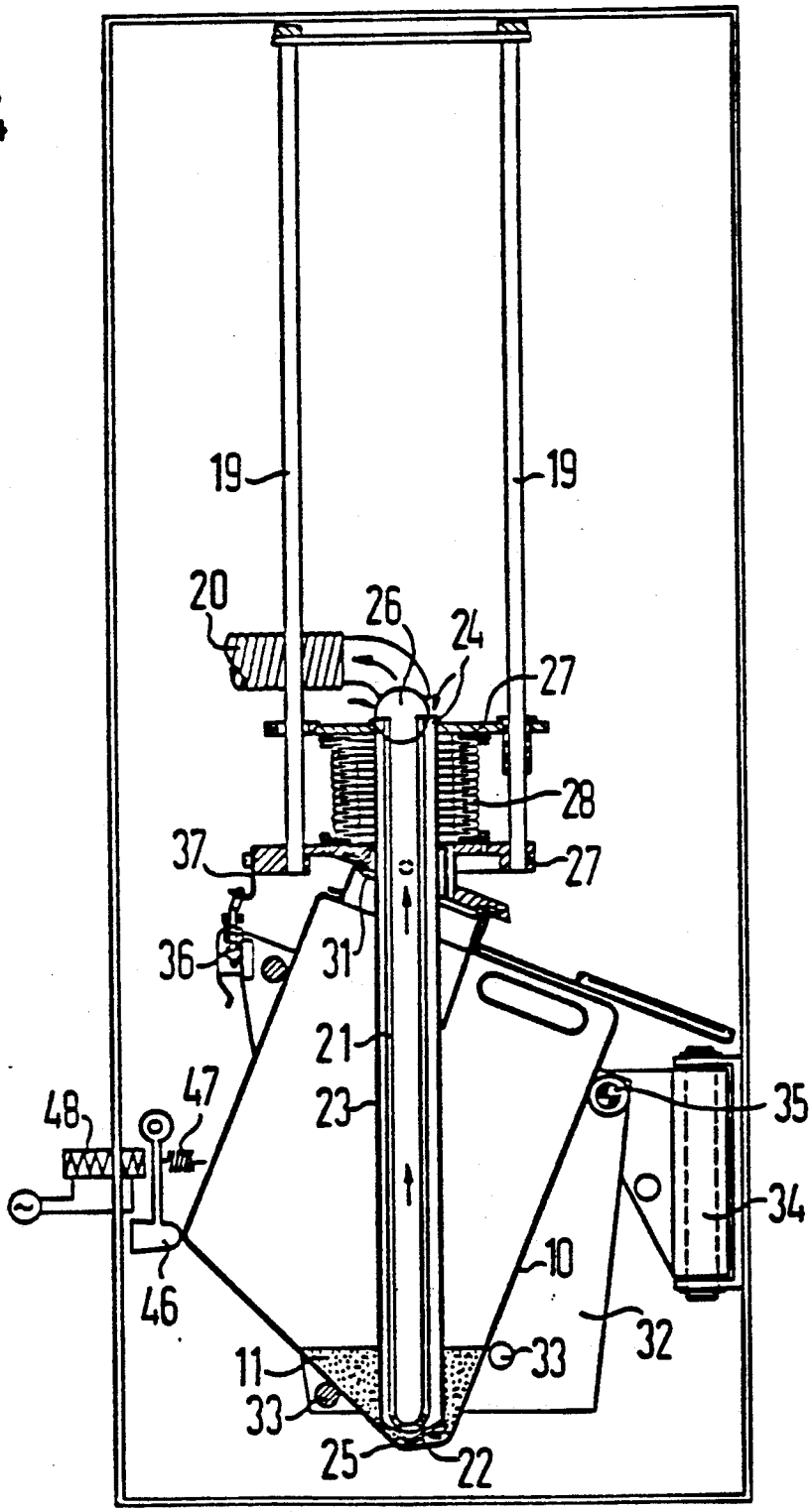
FIG. 4 is a schematic sectional view of the toner delivery region of the printer means, partially in sectional illustration with a nearly completely emptied toner container.
Figure 5A:
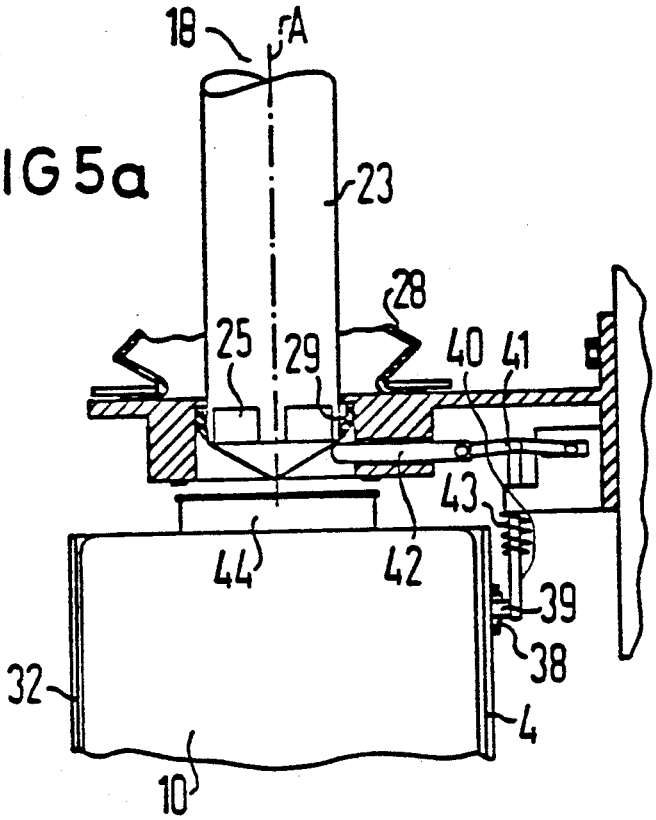
FIGS. 5*a* and 5*b* is a sectional view of the safety mechanism for the suction nozzle in its, secured condition.
Figure 5B:
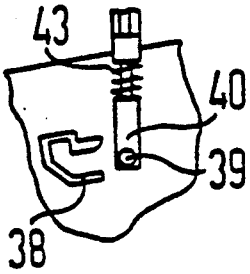
Figure 6A:
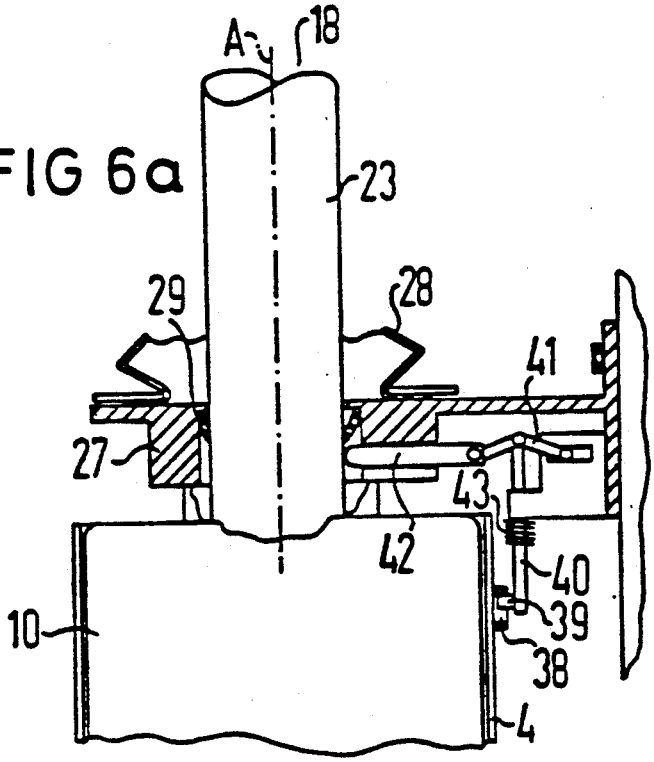
FIGS. 6*a* and 6*b* is a sectional view of the safety mechanism for the suction nozzle in its unsecured condition.
Figure 6B:
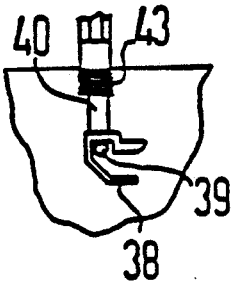

According to FIG. 4, the suction nozzle 18 comprises an inside tube 21 cut wedge-like at its bottom end that is in communication with the flexible suction tube 20 and comprises draw-in openings 22 for the toner. The inside tube 21 is completely surrounded by an outside tube 23 arranged at a distance therefrom that, first, comprises an air intake opening 24 at its upper part that opens into the environment and, second, comprises toner entry openings 25 at its tip in the take-in region. The spacing and the guidance of the inside tube 21 are effected by spacer elements (not shown here) that, for example, can be composed of three strips of expanded cellular material uniformly distributed over the circumference.

In order to keep lumpy toner residues away from the delivery to the printer station, the toner entry openings 25 can be covered by a toner sieve that covers the take-in region of the suction nozzle.

Figure 7:
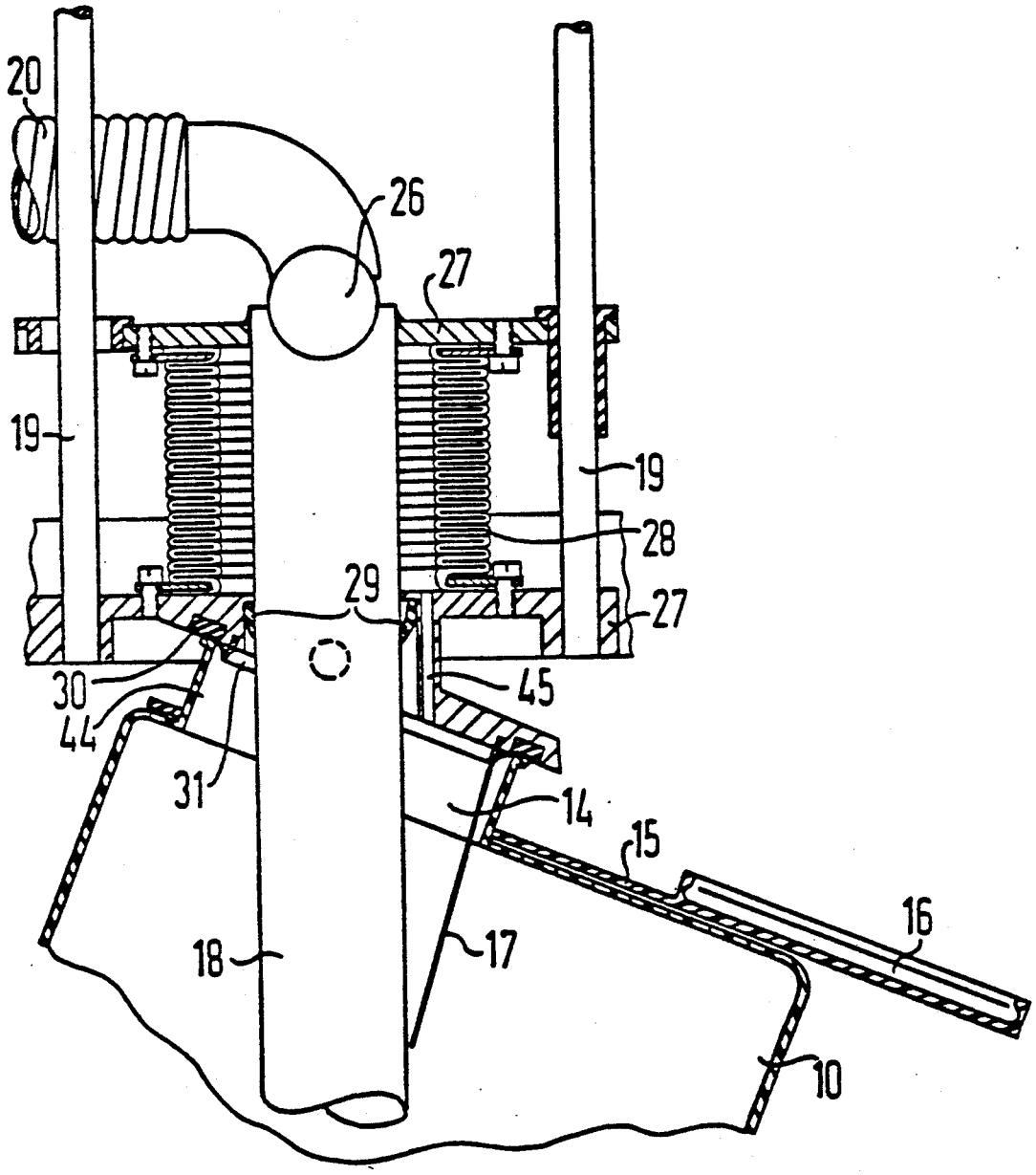
FIG. 7 is a schematic sectional view of the adapter region of the draw-off means.

The suction nozzle itself is arranged in vertically displaceable fashion via a handle 26. Carrier elements 27 are provided to this end that guide the suction nozzle between the guide rods 19. In order to protect the suction nozzle and in order to prevent an emergence of toner into the environment, the suction nozzle 18 is surrounded by a sheath in the form of a rubber accordion bellows 28. This sheath 28 is secured to the carrier elements 27 at the top and bottom, whereby the lower carrier element 27 is fashioned as an adapter for connecting the toner container 10 and as a lower guide for the suction nozzle 18. The adapter is thereby stationarily arranged and contains an annular stripper ring 29 (FIG. 7) for stripping toner residues from the suction nozzle 18; further, a safety means fashioned according to FIGS. 5*a*, 5*b*, 6*a* and 6*b* is also provided, this to be set forth later. The actual connector part for the toner container is composed of a sealing ring 30 of expanded cellular material for the filling and emptying opening and of a cutting ring 31 that has the job of cutting through the foil 17 when the toner container 10 is introduced.

Further, the receptacle means contains a receptacle container 32 for the toner container that comprises two wall surfaces between which retaining rods 33 for the toner container are arranged. The receptacle container 32 is pivotably secured to a rotary hinge 34, wherewith the receptacle container 32 can be pivoted out of the interior of the receptacle region (device compartment) of the printer.

The receptacle container 32 is also vertically pivotable around the fastening axis 35 at the rotary hinge 34 and comprising a clamp mechanism 36 that interacts with a corresponding hook 37 at the adapter of the draw-off devices.

According to FIGS. 5*a*, 5*b*, 6*a* and 6*b*, a catch nose 38 is located in a side wall of the receptacle container 32, this catch nose 38 interacting with a corresponding pin 39 of a lifter rod 40 that is resiliently seated in the adapter. The lifter rod 40 seated in the adapter is in communication via a toggle lever 14 with a retaining pin 42 secured therein. A spring 43 encircles the lifter rod 40.

The function of the described apparatus is then as follows: the toner container 10 comprising foil seal 17 and hinged-open cover 16 is swivelled into the inside of the receptacle region of the printer in the receptacle container 30, being swivelled via the rotary hinge 34. By turning around the fastening axis 35, a clamp mechanism 36 brings the toner container 10 arranged in the receptacle container 32 into engagement with the adapter. Before, however, the neck 44 of the toner bottle engages into the sealing ring 30 of expanded cellular material, a circular sector of about 340° is cut into the foil seal by the cutting ring 31.

When the neck 44 of the toner bottle engages into the sealing ring 30 of expanded cellular material, the safety mechanism of FIGS. 5*a*, 5*b*, 6*a* and 6*b* releases the suction nozzle 18. The suction nozzle 18 is fixed by a retaining pin 42 that is connected to the toggle mechanism 41. Due to the swivel motion of the receptacle container 32 around the fastening axis 35, the pin 39 on the lifter rod 40 enters into engagement with the catch nose 38 arranged on the receptacle container and having an appertaining leading bevel. The lifter rod 40 is lifted and the retaining pin 42 moved by the toggle lever 41 releases the suction nozzle 18. As a result of its dead weight, the suction nozzle 18 penetrates into the toner container 10 and thereby presses the slit foil seal 17 that is connected only at a tongue into the interior of the bottle where the actual toner delivery can now begin. The catch nose 38 prevents the receptacle container 32 from being swivelled away when the suction nozzle 18 is introduced.

After the conclusion of the conveying event, i.e. when the toner container 10 is changed, the suction nozzle 18 is drawn from the toner container 10 with the handle 26. The toner adhering to the suction nozzle 18 is removed by the stripper ring 29 when the suction nozzle 18 is withdrawn and falls back into the inside of the bottle. The rubber bellows 28 covers the suction nozzle 18 that may still be slightly contaminated and thus offers protection against accidental contact.

Upon compression of the rubber bellows 28, i.e. given penetration into the toner bottle 10, a pressure equalization takes place through a bore 45.

When the suction nozzle 18 has been entirely withdrawn from the toner bottle 10, the compression spring 43 can press the lifter rod 40 in downward direction and thereby inhibit the suction nozzle 18 with the retaining pin 42. At the same time, the pin 39 that interacts with the catch nose 38 is released and the receptacle container 32 together with the toner container 10 can be swivelled away.

In order to assure a reliable delivery of the toner 11 into the draw-off region of the suction nozzle 18 when the suction nozzle is introduced, a shaker means can be provided (FIG. 4) in the receptacle region, this shaker means, for example, being composed of a beater hammer 46 that is swivelably arranged in the receptacle means and that can be deflected via an electromagnet 48 opposite a spring power 47. This beater hammer 46 thereby forms a type of shaker means that strips toner that may still be potentially adhering to the inside walls of the toner container 10.

Given printer means operating according to the principle of electrophotography, the residual toner remaining on the photoconductive drum after the transfer event must be conveyed away from the photoconductive drum by a brush cleaning station applied to an underpressure and must be deposited in a collecting container by a cyclonic filter.

Figure 8:
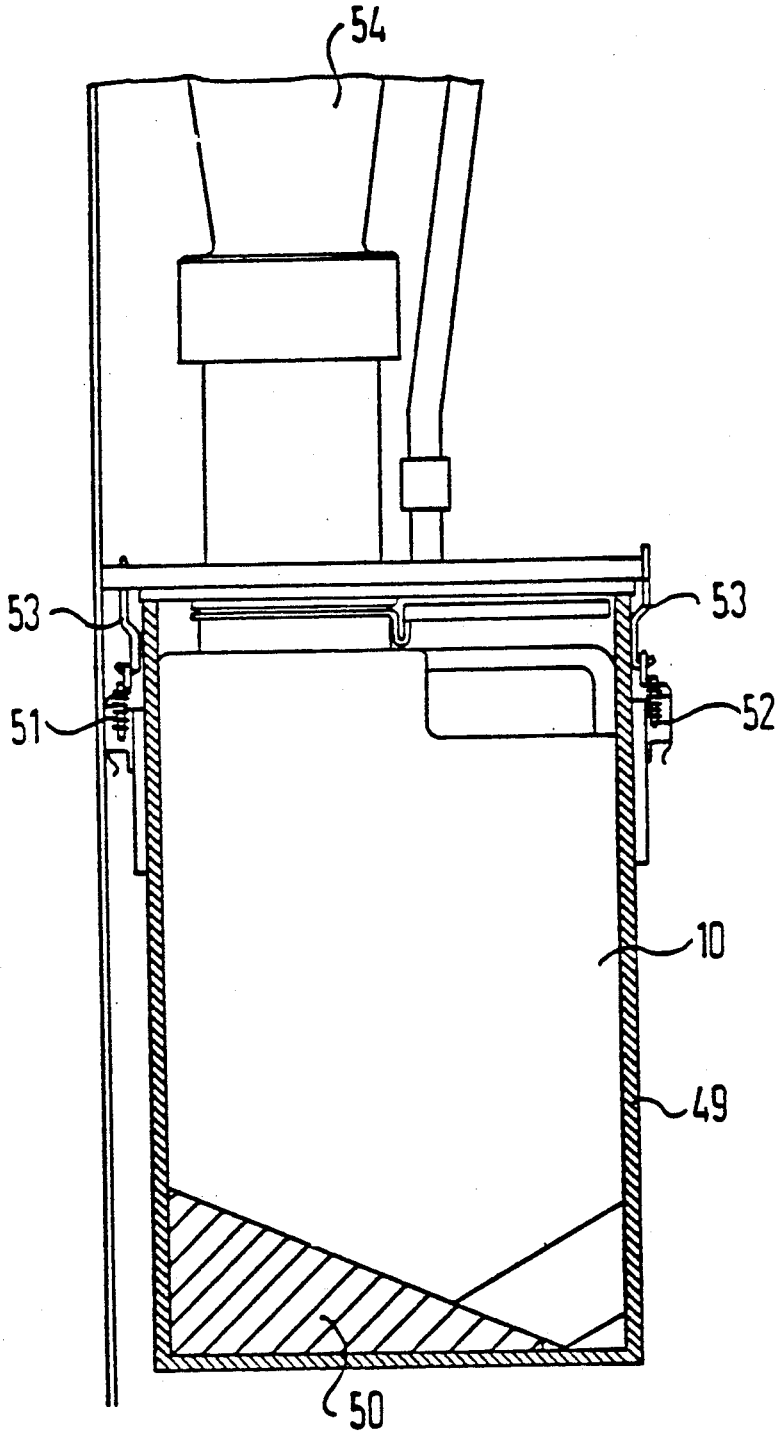
FIG. 8 is a schematic view of the emptying region of the printer means with inserted toner container as collecting container.

According to FIG. 8, an empty toner container 10 can serve as collecting container for this residual toner. To this end, an empty toner container is inserted into a holding container 49 that comprises a wedge-shaped insert 50 in its bottom region, this insert 50 being shaped to correspond with the bottom supporting surface 12 of the toner container 10. Via appropriate clamp mechanisms 51 and 52, the holding container 49 together with the empty toner container 10 arranged therein can be secured to the hook 53 of the exit pipe 54 of the cyclonic filter (not shown here). Although other modifications and changes may e suggested by those skilled in the art, it is the intention o the inventors to embody within the apparent warranted hereon all changes and modifications as reasonably and properly come within the scope of their contribution to the art.

I claim:

1. A system for the transfer of toner from a toner transport container having a filing and emptying opening into a developer station of a non-mechanical printer or copier mans, comprising:

a non-mechanical printer or copier means, a suction nozzle mounted connected to said non-mechanical prime or copier means, a guide means of guiding said suction nozzle into the toner transport container, a toner-tight protective sheath mounted about said suction nozzle to prevent escape of toner into the environment, a pipe line connecting said suction nozzle in communication with the developer station of said non-mechanical priner or copier means, and an adapter being connected of the protective sheath and being releasably fastenable to provide a releasable, toner-tight fastening to the filling and emptying opening o the toner container, said suction nozzle passing through said adapter into the toner container for emptying the toner container.

2. A system according to claim 1, wherein aid guide means mounted said suction nozzle in vertically displaceable fashion and further comprising:

a holding mechanism mounted below said guide means in said non-mechanical printer or copier means and constructed to hold the toner container in a position that permits the suction nozzle to move into the toner container on the basis of its own weight.

3. A system according to claim 2, wherein said holding mechanism comprises a means for pivoting the toner container between a position in which said suction nozzle is movable into the toner container and a position unaligned with said suction nozzle.

4. A system according to claim 1, wherein aid adapter comprises a safety means or enabling the suction nozzle to enter the toner transport container only after the transport container has been connected to the adapter and for preventing release of the adapter when the suction nozzle is in the transport container.

5. A system according to claim 1, wherein the filling and emptying opening of the toner transport container is initially covered by a foil, and wherein the adapter comprises a cutter means or puncturing the foil that covers the filing and emptying opening of the toner container.

6. A system according t claim 1, wherein said protective sheath comprises a flexible accordion bellows having a fist end secured to the suction nozzle and a second end connected to the adapter.

7. A system according o claim 1, wherein aid adapter comprises a toner stripper ring mounted about the suction nozzle, said suction nozzle being movable relative to said toner stripper ing as said suction nozzle is guided by said guide means to remove toner from the suction nozzle as the suction nozzle moves thought the toner stripper ing.

8. A system for the transfer of toner from a toner transport container into a developer station of a non-mechanical printer ro copier means, comprising:

a suction nozzle, a guide means mounting said suction nozzle in vertically displaceable fashion, a toner-tight protective sheath mounted about said suction nozzle, a pipe line connecting said suction nozzle in communication with the developer station, an adapter being connected to the protective sheath and being releasably fastenable to provide a releasable, toner-tight fastening to the filling and emptying opening o the toner container, said suction nozzle passing through said adapter into the eh toner container for emptying the toner container;

a holding mechanism mounted below said guide means and constructed to hold the toner container in a position that permits the suction nozzle to move into the toner container on the basis of its own weight;

the toner container comprise a funnel-shaped floor that forms a lowest collecting region for toner in the toner container, a filling and emptying opening and the collecting region of the toner container are arranged relative to one another such that, given holding of the toner container the holding mechanism in a removal position wherein the collecting region is at a lowest region of the toner container, the suction nozzle is expendable into the collecting region.

9. A system according to claim , wherein ad suction nozzle comprises an inside tube having take-in opening and connected to the pipeline and comprises an outside tube enveloping the inside tube at a distance from said inside tube, the outside tube comprises toner entry openings and air intake openings, so that intake air flowing thought the outside tube draws toner through the toner entry opening into the inside tube.

* * * * *

UNITED STATES PATENT AND TRADEMARK OFFICE

CERTIFICATE OF CORRECTION

PATENT NO. : 5,074,342

DATED : December 24, 1991

INVENTOR(S) : Erich Kraehn

It is certified that error appears in the above-indentified patent and that said Letters Patent is hereby corrected as shown below:

In claim 1, column 7, line 23, change "mans" to --means--.
In claim 1, column 7, line 39, change "o" to --of--.

In claim 2, column 7, line 43, change "mounted" to --mounts--.

In claim 6, column 8, line 9, change "t" to --to--.

In claim 7, column 8, lines 16 and 19, change "ing" to --ring--.

In claim 8, column 8, line 24, before "a guide" insert --a guide means for guiding said suction nozzle into the toner transport container, said" delete "a".
In claim 8, column 8, line 34, delete "eh".
In claim 8, column 8, line 41, delete "comprise" and substitute "comprises".
In claim 8, column 8, line 46, before "the", second occurrence insert --in--.
In claim 8, column 8, line 49, change "expendable" to--extendable--

UNITED STATES PATENT AND TRADEMARK OFFICE

CERTIFICATE OF CORRECTION

PATENT NO. : 5,074,342

DATED : December 24, 1991

INVENTOR(S) : Erich Kraehn

It is certified that error appears in the above-identified patent and that said Letters Patent is hereby corrected as shown below:

In claim 9, line 51, column 8, change "ad" to --said--.
In claim 9, line 52, column 8, change "opening" to --openings--.

Signed and Sealed this

Tenth Day of March, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,074,342
DATED : December 24, 1991
INVENTOR(S) : Erich Kraehn

It is certified that error appears in the above-indentified patent and that said Letters Patent is hereby corrected as shown below:

Column 8, line 51, after "claim" add --1--.

Signed and Sealed this

Sixteenth Day of June, 1998

*Attest:*

*Attesting Officer*

Bruce Lehman

BRUCE LEHMAN

*Commissioner of Patents and Trademarks*